United States Patent [19]

Bezin

[11] Patent Number: 4,680,921

[45] Date of Patent: Jul. 21, 1987

[54] SAFETY STIRRUP FOR HORSE-RIDING

[76] Inventor: Michel Bezin, 42bis, Boulevard Victor Hugo, F-58000 Nevers, France

[21] Appl. No.: 850,543

[22] Filed: Apr. 11, 1986

[30] Foreign Application Priority Data

Apr. 12, 1985 [FR] France ..... 85 05513

[51] Int. Cl.[4] ..... B68C 3/00

[52] U.S. Cl. ..... 54/49

[58] Field of Search ..... 54/47, 49

[56] References Cited

U.S. PATENT DOCUMENTS

| | | | |
|---|---|---|---|
| 897,974 | 9/1908 | Fuchs | 54/49 |
| 1,102,762 | 7/1914 | Korittke | 54/49 |
| 2,537,532 | 1/1951 | Hrabal | 54/49 |

FOREIGN PATENT DOCUMENTS

| | | | |
|---|---|---|---|
| 403632 | 11/1909 | France . | |
| 19916 | 3/1910 | Norway | 54/47 |
| 372211 | 11/1963 | Switzerland . | |
| 753418 | 7/1956 | United Kingdom . | |

*Primary Examiner*—Robert P. Swiatek

*Attorney, Agent, or Firm*—Oblon, Fisher, Spivak, McClelland & Maier

[57] ABSTRACT

A safety stirrup detachably connected to the stirrup-leather in order to release the rider's foot in the event of a fall comprises a coupling device having two jaws for clamping the top portion of the stirrup head. A forward pivotal displacement of the stirrup with respect to the stirrup-leather causes rotation of a cam provided at the upper end of the stirrup head. The two jaws are opened-out by a top wedge of the cam through an angle of approximately 30° to 45° while a bottom wedge of the cam increases the separation of the jaws, thus releasing the stirrup.

11 Claims, 8 Drawing Figures

Fig. 3
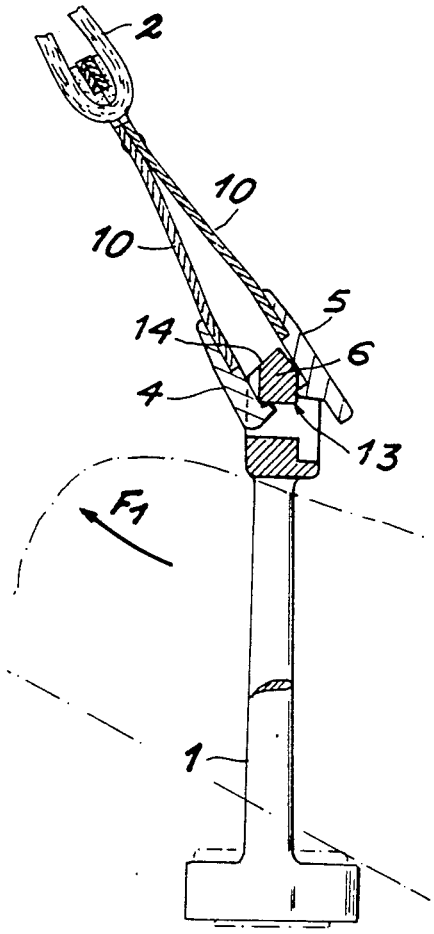
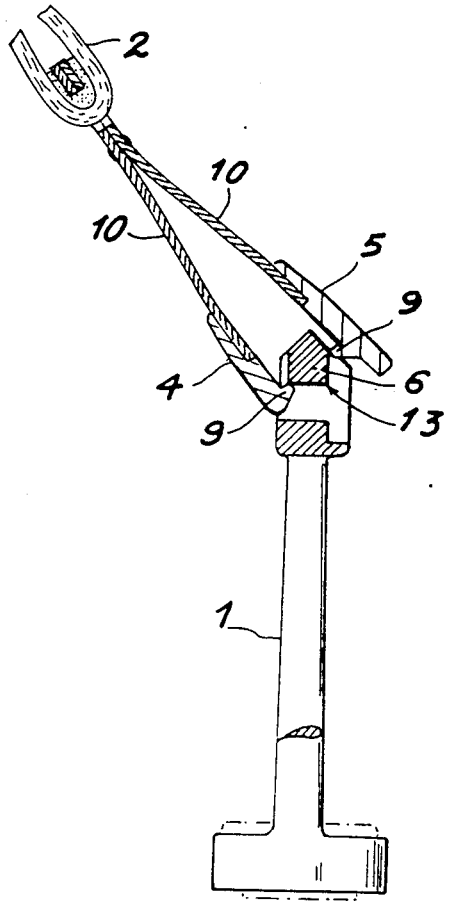
Fig. 4

SAFETY STIRRUP FOR HORSE-RIDING

BACKGROUND OF THE INVENTION

1. Field of the Invention

The present invention relates to a safety stirrup for horse-riding. The stirrup is detachably connected to the corresponding stirrup-leather in order to ensure release of the rider's foot in the event of a fall. In fact, with stirrups of conventional type, the rider's foot is liable to be jammed in the corresponding stirrup, thus exposing the rider to the potential danger of a serious accident.

2. Description of the Prior Art

Different systems have already been proposed for releasing the feet of riders at the time of a fall. However, the systems which exist at the present time do not make it possible to solve this problem in a wholly satisfactory manner.

French Pat. No. 403 632 thus describes a stirrup having a head which is attached to the corresponding stirrup-leather by means of a support which is intended to permit release of the stirrup under certain circumstances. This support is designed in the form of a U-shaped arch, the legs of which are located in planes extending at right angles with respect to the general plane of the stirrup. Each leg of the arch is provided at the lower end with a projection engaged in a cavity formed on the corresponding side of a protuberance formed on the top portion of the head of the stirrup. It therefore appears reasonable to suppose that a fall experienced by the rider produces a rotational displacement of the protuberance of the stirrup head between the two legs of the arch-shaped support, thereby ensuring that the projections of this latter are withdrawn from the cavities of said protuberance. However, since the two legs of the arch-shaped support are located in planes which extend at right angles with respect to the general plane of the stirrup, a fall tends in actual practice to produce a rotational displacement of the stirrup support within the loop formed by the stirrup-leather or else to result in twisting of the stirrup-leather. In either case the result thereby achieved is that the stirrup head is not released from its support, since a releasing action necessarily calls for a rotation of the upper protuberance of the stirrup head between the two legs of its support.

British Pat. No. 753,418 describes a safety stirrup system in which the stirrup head is attached to the corresponding stirrup-leather by means of a coupling device comprising a resilient strip for maintaining the stirrup head applied against a retaining lug which is engaged in the eye of the head while permitting disengagement of the lug in the event of an abnormal pivotal force exerted on the stirrup. Here again, this is far from being a perfect solution, since the working play of the stirrup head on the retaining lug is substantial, and this play facilitates untimely disengagement of the stirrup with respect to its coupling device. Moreover, the system thus provided does not permit release of the stirrup under precise conditions of disengagement in respect of a predetermined twisting motion. A further drawback of this system lies in its inadequate strength and durability, since the resilient strip which has the function of holding the stirrup in position is subject to very rapid deterioration.

OBJECT OF THE INVENTION

For the reasons given in the foregoing, the aim of the present invention is to provide a stirrup which permits the achievement of maximum safety of foot release in the event of a fall of the rider and in respect of a predetermined twisting motion, this stirrup being also of extremely rugged design.

SUMMARY OF THE INVENTION

The invention is accordingly directed to a safety stirrup for horse-riding. The stirrup head is attached to the corresponding stirrup-leather by means of a coupling device comprising a retaining element engaged in the eye of the stirrup head and a resilient member for maintaining this latter applied against the retaining element while permitting disengagement of the retaining element in the event of an abnormal pivotal motion between the stirrup and the stirrup-leather. The safety stirrup is distinguished by the following features:

the coupling device aforesaid is constituted by a resilient clamp having two jaws normally located in planes substantially parallel to the general plane of the corresponding stirrup, the jaws being adapted to clamp the top portion of the stirrup head and being provided with bottom retaining noses engaged in the eye of the stirrup head;

the top portion of the stirrup head aforesaid has the shape of a cam so designed as to be capable of causing incipient separation of the two jaws in the event of rotation of the cam about its own axis up to an angle of the order of 30° to 45° approximately, the lower end of the cam being such as to form a wedge corner which is capable at the time of rotation of engaging between the bottom retaining noses of the two jaws in order to increase their relative spacing and thus to permit escape of the stirrup.

In accordance with another distinctive feature of the safety stirrup under consideration, the cam which constitutes the top portion of the stirrup head has a flat bottom face which bears on the bottom retaining noses of the two jaws as well as two flat faces perpendicular to the bottom face and parallel to the general plane of the stirrup, the two jaws being normally applied against the two flat faces.

In accordance with yet another distinctive feature, the coupling-clamp jaw which is intended to be placed on the rearward side has a downward extension in the form of a lug, the lug being placed opposite to the lower portion of the stirrup head so as to constitute a stop which prevents any rearward pivotal displacement of the stirrup.

Thus a release of the rider's foot can occur only in the event of a relative pivotal displacement of the stirrup in the forward direction with respect to the corresponding stirrup-leather and therefore in the event of an abnormal force produced by a fall of the rider.

BRIEF DESCRIPTION OF THE DRAWINGS

Other features of the invention will be more apparent to those skilled in the art upon consideration of the following description and accompanying drawings, wherein:

FIGS. 3 and 4 are similar views illustrating two successive steps involved in release of the stirrup in the event of a fall of the rider;

DESCRIPTION OF THE PREFERRED EMBODIMENTS

Figure 1:
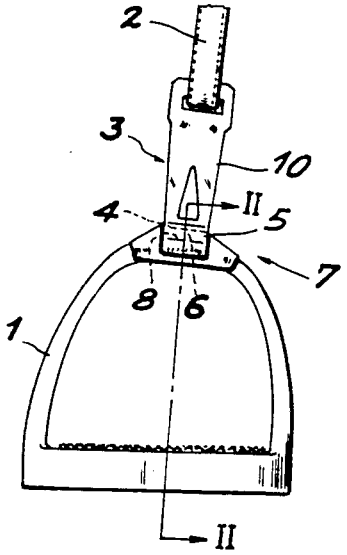
FIG. 1 is a view in front elevation of a first embodiment of the safety stirrup in accordance with the invention and of its device for coupling the stirrup and corresponding stirrup-leather.
Figure 5:
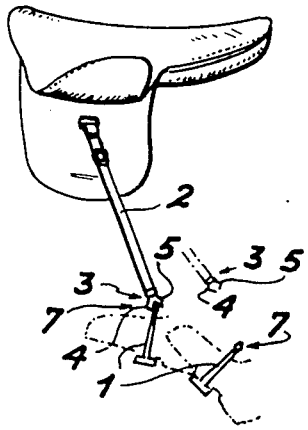
FIG. 5 is a view in elevation showing a saddle which carries the stirrup in accordance with the invention, and illustrating the conditions of operation of the system as a whole.

FIGS. 1 to 6 illustrate one example of construction in which a stirrup 1 is attached to a stirrup-leather 2 by means of a coupling device designated by the general reference 3. The stirrup 1 has a stirrup head 7 which in turn has a stirrup-head eye 8. The coupling device 3 is constituted by a resilient clamp, the two jaws 4 and 5 of which are disposed in two planes substantially parallel to the general plane of the stirrup 1. The top portion 6 of the stirrup head 7 (or, in other words, the portion of the stirrup head which is located above the stirrup-head eye 8) is imprisoned between the two aforementioned clamp jaws 4 and 5.

Provision is made on the opposite internal faces of the two jaws 4 and 5 for noses 9 which are adapted to engage within the eye 8 of the stirrup head 7. The noses 9 thus serve as retaining elements for the top portion 6 of the stirrup head 7.

The two jaws 4 and 5 are carried by two resilient strips 10, the upper ends of which are joined together by means of spot welds 11 or rivets, for example. Furthermore, the upper ends of the two strips 10 are provided with an opening 12 within which the corresponding stirrup-leather 2 is engaged. Thus the two resilient strips 10 constitute resilient means which tend to maintain the two jaws 4 and 5 applied against each other in order to ensure that the stirrup 1 and the stirrup-leather 2 are coupled together.

The top portion 6 of the stirrup head 7 is constituted by a cam having a profile such that the cam is capable of causing incipient separation of the two retaining jaws 4 and 5 in the event of rotation of the cam about its own axis up to an angle of the order of 30 ° to 45° approximately. Furthermore, the lower portion of the cam has a wedge corner 13 which is sized, shaped, and positioned to engage between the noses 9 of the two retaining jaws 4 and 5 after a rotation of the top portion 6 has occurred as mentioned above, thereby increasing the relative spacing of the jaws 4 and 5 in order to permit escape of the stirrup head 7.

To this end, apart from a top rib 14 whose function will be explained hereinafter, the top portion 6 has a cross-section of square or rectangular shape. The cam thus has a flat and horizontal bottom face 15 which serves as a bearing surface for applying the cam against the two retaining noses 9 of the two jaws 4 and 5. However, the cam also has two flat faces 16 which are perpendicular to the bearing surface and extend in planes parallel to the general plane of the stirrup 1. Accordingly, the two jaws 4 and 5 are normally applied against these two flat faces, thus firmly maintaining the stirrup 1 in the position shown in FIG. 2 without any possibility of play with respect to the coupling device 3.

Figure 6:
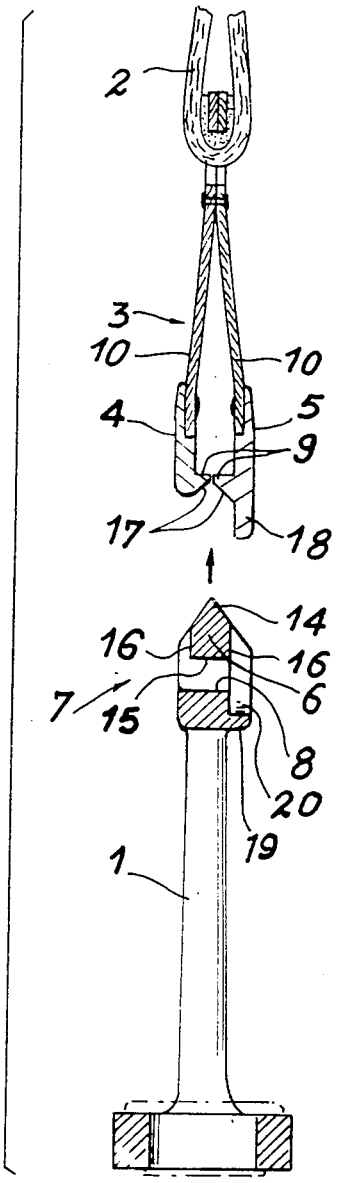
FIG. 6 is a fragmentary view which is similar to FIG. 2 and illustrates the mode of re-engagement of the stirrup head between the two retaining jaws.

The top portion 6 as designed in the manner just described is provided in addition with a top rib 14, as mentioned earlier. The top rib 14 has a cross-section in the shape of a triangle, the apex of which is directed upwards. The top rib 14 is in fact intended to constitute a virtual top wedge, the intended function of which is to permit ready repositioning of the top portion 6 between the two retaining jaws 4 and 5. In combination with the top wedge, the bottom faces of the two retaining noses 9 are provided with chamfered edges 17 which are sized, shaped, and positioned to facilitate engagement of the top wedge between the two noses 9 in order to cause a momentary separation of the two retaining jaws 4 and 5 at the time of re-engagement of the top portion 6 between the two jaws 4 and 5 (as shown in FIG. 6).

In accordance with another important feature, the retaining jaw 5 which, in use, is placed so that it faces toward the rear end of the horse has a downward extension in the form of a lug 18. The lug 18 is placed opposite to the lower portion 19 of the stirrup head 7 (or, in other words, opposite to the portion located beneath the stirrup-head eye 8). Preferably, the lug 18 is normally engaged within a stepped recess 20 formed in the lower portion 19. Thus, the lug 18 constitutes a stop which prevents any possibility of rearward pivotal displacement of the stirrup 1 with respect to the coupling device 3.

In consequence, only a relative movement of pivotal displacement in the forward direction is permitted to take place between the stirrup 1 and the coupling device 3 as shown in FIG. 3. In more precise terms, when the rider falls in a backward direction, a relative movement of pivotal displacement of the stirrup 1 takes place in the forward direction as shown by the arrow F1 whilst the stirrup-leather 2 and the coupling device 3 carried by the stirrup-leather 2 are lifted in the backward direction.

Thus the top portion 6 is caused to rotate about its own axis between the two jaws 4 and 5 up to an angle of rotation of the order of 30° to 45°. This accordingly produces incipient separation of the two jaws 4 and 5 as illustrated in FIG. 3. On completion of this movement of rotation, the bottom wedge corner 13 of the top portion 6 (namely, the rear corner) is located opposite to the gap which exists at this moment between the two retaining noses 9 by reason of the incipient separation of the two jaws 4 and 5. As a result of the tractive force exerted by the stirrup-leather 2, the wedge corner 13 engages between the two retaining noses 9 and thus produces a sharper increase in relative spacing of the two jaws 4 and 5, with the result that the stirrup head 7 is finally permitted to escape (as shown in FIG. 4).

Accordingly, the stirrup 1 is released under conditions which may be relied upon to ensure the maximum degree of safety. However, during a normal horse-riding trip, the stirrup 1 is securely maintained in position without any play in the coupling device 3, which provides a coupling between the stirrup 1 and the stirrup-leather 2. This result is achieved by virtue of the fact that the two retaining jaws 4 and 5 are resiliently applied against the flat faces 16 of the top portion 6 of the stirrup head 7. Moreover, the basic design concept of the device in accordance with the invention is such that any abnormal twisting force exerted on the rider's foot and resulting from an incipient rearward falling movement of the rider produces a movement of rotation of the top portion 6 between the two retaining jaws 4 and 5 and consequently results in disengagement of the stirrup head 7 from the two jaws 4 and 5, this movement being performed automatically and in a wholly reliable manner. In this connection, an essential condition to be satisfied is that the retaining jaws 4 and 5 of the stirrup clamp must be located in planes parallel to the general plane of the stirrup 1 and that rotation of the top portion 6 must produce incipient separation of the two jaws 4 and 5 followed by a more pronounced movement of relative outward displacement as a result of engagement of the bottom wedge corner 13 between the two retaining noses 9. The practical conditions of stirrup release are in any case illustrated in FIG. 5.

Figure 7:
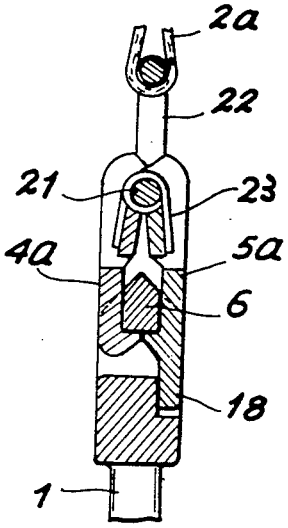
FIGS. 7 and 8 are fragmentary sectional views which are similar to FIG. 2 but show different forms of construction of the safety stirrup in accordance with the invention.

FIG. 7 shows a second embodiment of the safety stirrup in accordance with the invention. The essential difference between the second embodiment and the first embodiment lies in the nature of the resilient means employed for maintaining the retaining jaws applied against each other.

In fact, in this form of construction, the upper ends of the two corresponding jaws 4*a* and 5*a* are pivoted about a common pivot pin 21 constituted by the bottom arm of a ring 22 within which is engaged the corresponding stirrup-leather 2*a*. The two retaining jaws 4*a* and 5*a* are maintained applied against each other by means of a torsion spring 23 placed around the pivot-pin 21. However, apart from this difference, the general structure of the second embodiment is the same as in the first embodiment. In consequence, the operation of the device is also the same.

Figure 8:
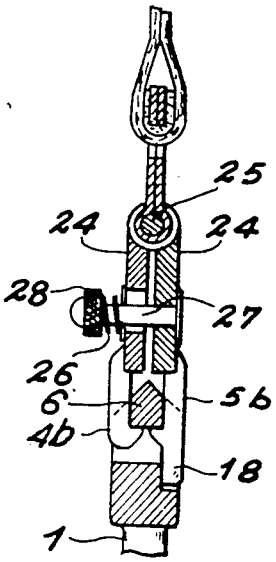
Figure 2:
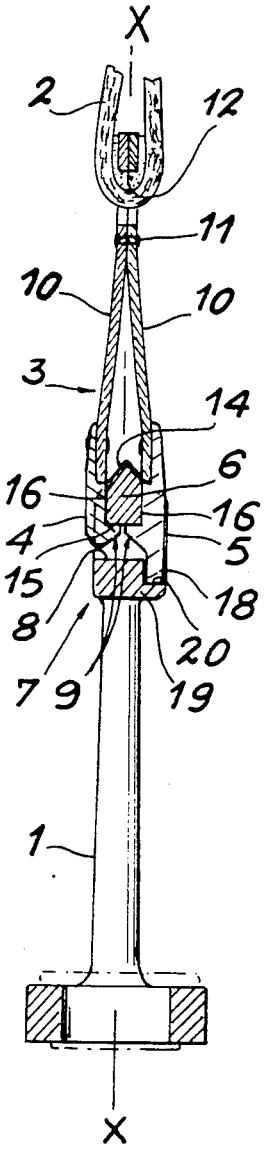
FIG. 2 is a vertical sectional view taken along line II—II of FIG. 1 but to a different scale.

FIG. 8 illustrates a third embodiment which differs from the previous forms of construction in regard to the nature of the resilient means employed for producing action on the top retaining jaws. In this case, the two corresponding jaws 4*b* and 5*b* are carried by two rigid supporting arms 24 which are pivotally mounted on a common pin 25. The resilient means employed for urging the two clamp jaws against each other consist of a pressure spring 26 placed around a threaded bolt 27 which is carried by one of the supporting arms 24 and passes through the other arm. The resilient restoring pressure exerted on the two retaining jaws 4*b* and 5*b* can be adjusted at will by means of a nut 28 screwed on the end of the threaded bolt 27.

Apart from this difference, however, the arrangement of the two jaws is again the same as in the first embodiment. The top portion 6 carried by the stirrup head 7 is also identical with the cam provided in the first embodiment and the operation is consequently the same.

However, the safety stirrup in accordance with the invention is not limited to the examples described in the foregoing, since these examples have been given solely by way of indication. Thus the resilient restoring means provided for the two retaining jaws could be different from those contemplated in the foregoing. If necessary, these resilient restoring means could consist of a block or pad of rubber or any other suitable elastic material.

What is claimed is:

1. A safety stirrup for horse-riding comprising a stirrup head having an eye and being attached to a corresponding stirrup-leather by means of a coupling device comprising a retaining element engaged in the eye of said stirrup head and a resilient member for maintaining said stirrup head applid against said retaining element while permitting disengagement of said retaining element in the event of an abnormal pivotal motion between said stirrup and said stirrup-leather, wherein said safety stirrup is distinguished by the following features:

(a) said coupling device comprises a resilient clamp having two jaws normally located in planes substantially parallel to the general plane of said stirrup, said two jaws being sized, shaped, and positioned to clamp the top portion of said stirrup head and being provided with bottom retaining noses engaged in the eye of said stirrup head and adjacently opposite one another;

(b) the top portion of said stirrup head has the shape of a cam so designed as to be capable of caussing incipient separation of said two jaws in the event of rotation of said cam about its own axis up to an angle of the order of 30° to 45° approximately, the lower end of said cam being such as to form a wedge corner which is capable of engaging between the bottom retaining noses of said two jaws in order to increase their relative spacing and thus to permit excape of said stirrup; and (c) the cam which constitutes the top portion of said stirrup head has a flat bottom face which bears on the bottom retaining noses of said two jaws as well as two flat faces perpendicular to said bottom face and parallel to the general plane of said stirrup, said two jaws being normally applied against said two flat faces.

2. A safety stirrup according to claim 1, wherein the one of said two jaws that, in use, is placed so that it faces toward the rear end of the horse has a downward extension in the form of a lug placed opposite to the lower portion of said stirrup head so as to constitute a stop that prevents any rearward pivotal displacement of said stirrup.

3. A safety stirrup according to claim 1, wherein said two jaws are carried by two resilient strips which are joined together at the upper ends thereof and constitute resilient means for maintaining said two jaws applied against each other.

4. A safety stirrup according to claim 3, and further comprising adjusting means for adjusting the value of a restoring force exerted by said resilient means on said two jaws.

5. A safety stirrup according to claim 1, wherein:

(a) said two jaws are pivotally mounted together on a common pin and (b) the safety stirrup further comprises a torsion spring or a pressure spring for maintaining said two jaws applied against each other.

6. A safety stirrup for horse-riding comprising a stirrup head having an eye and being attached to a corresponding stirrup-leather by means of a coupling device comprising a retaining element engaged in the eye of said stirrup head and a resilient member for maintaining said stirrup head applied against said retaining element while permitting disengagement of said retaining element in the event of an abnormal pivotal motion between said stirrup and said stirrup-leather, wherein said safety stirrup is distinguished by the folliowing features:

(a) said coupling device comprises a resilient clamp having two jaws normally located in planes substantially parallel to the general plane of said stirrup, said two jaws being sized, shaped, and positioned to clamp the top portion of said stirrup head and being provided with bottom retaining noses engaged in the eye of said stirrup head;

(b) the top portion of said stirrup head has the shape of a cam so designed as to be capable of causing incipient separation of said two jaws in the event of rotation of said cam about its own axis up to an angle of the order of 30° to 45° approximately, the lower end of said cam being such as to form a wedge corner which is capable of engaging between the bottom retaining noses of said two jaws in order to increase their relative spacing and thus to permit escape of said stirrup; and (c) the top portion of said stirrup head is provided with a top rib of triangular cross-section in which the apex of the triangle is located uppermost so as to constitute a virtual separating wedge, the intended function of said top wedge being to permit ready repositioning of this portion of said stirrup head between said two jaws.

7. A safety stirrup according to claim 6, wherein the cam which constitutes the top portion of said stirrup head has a cross-section of square or rectangular shape apart from the top rib of triangular cross-section provided at the top in order to serve as a re-engagement wedge.

8. A safety stirrup according to claim 6 wherein the one of said two jaws that, in use, is placed so that it faces toward the rear end of the horse has a downward extension in the form of a lug placed opposite to the lower portion of said stirrup head so as to constitute a stop which prevents any rearward pivotal displacement of said stirrup.

9. A safety stirrup according to claim 6 wherein said two jaws are carried by two resilient strips which are joined together at the upper ends thereof and constitute resilient means for maintaining said two jaws applied against each other.

10. A safety stirrup according to claim 6 wherein:

(a) said two jaws are pivotally mounted together on a common pin and (b) the safety stirrup further comprises a torsion spring or a pressure spring for maintaining said two jaws applied against each other.

11. A safety stirrup according to claim 10 and further comprising adjusting means for adjusting the value of a restoring force exerted by said torsion spring or pressure spring.

* * * * *